United States Patent [19]

Marach

[11] Patent Number: 4,944,691

[45] Date of Patent: Jul. 31, 1990

[54] HOLDER FOR A REMOVABLE CIRCUIT ELEMENT

[75] Inventor: David R. Marach, Marengo, Ill.

[73] Assignee: Cooper Industries, Inc., Houston, Tex.

[21] Appl. No.: 382,096

[22] Filed: Jul. 19, 1989

Related U.S. Application Data

[63] Continuation-in-part of Ser. No. 232,322, Aug. 15, 1988, Pat. No. 4,872,262.

[51] Int. Cl.[5] ..... H01R 9/28

[52] U.S. Cl. ..... 439/516; 439/621; 439/721; 361/430

[58] Field of Search ..... 29/874, 876, 882, 884; 439/621, 830, 885, 721, 723, 724, 718, 516, 622; 337/188; 361/349, 355, 430, 431

[56] References Cited

U.S. PATENT DOCUMENTS

| | | | |
|---|---|---|---|
| 3,140,364 | 7/1964 | Swanke et al. | 29/876 |
| 3,909,767 | 9/1975 | Williamson et al. | 337/198 |
| 3,962,782 | 6/1976 | Williamson et al. | 29/414 |
| 4,471,158 | 9/1984 | Roberts | 439/516 |
| 4,722,701 | 2/1988 | Bradt | 439/718 |

*Primary Examiner*—Gary F. Paumen

*Attorney, Agent, or Firm*—James A. Gabala; Jon Carl Gealow

[57] ABSTRACT

A holder for a removable plug-in circuit element is disclosed. The holder comprises an insulated base, an electrical bus member, and a plurality of terminal members which are formed from the same blank of metal as the metal bus member. The bus member comprises a plurality of branches joined to a common trunk with each branch having at its free end an integral terminal. Each terminal member has at one end an electrical terminal and, at an opposite end, an integral terminal which is aligned to the free end of one lateral branch. In one embodiment of the invention, the holder includes an insulated cover which is carried by the base and which has a plurality of apertures which aligned to the terminals of each branch so as to receive the ends of a removable plug-in circuit element therein.

29 Claims, 4 Drawing Sheets

FIG. 1
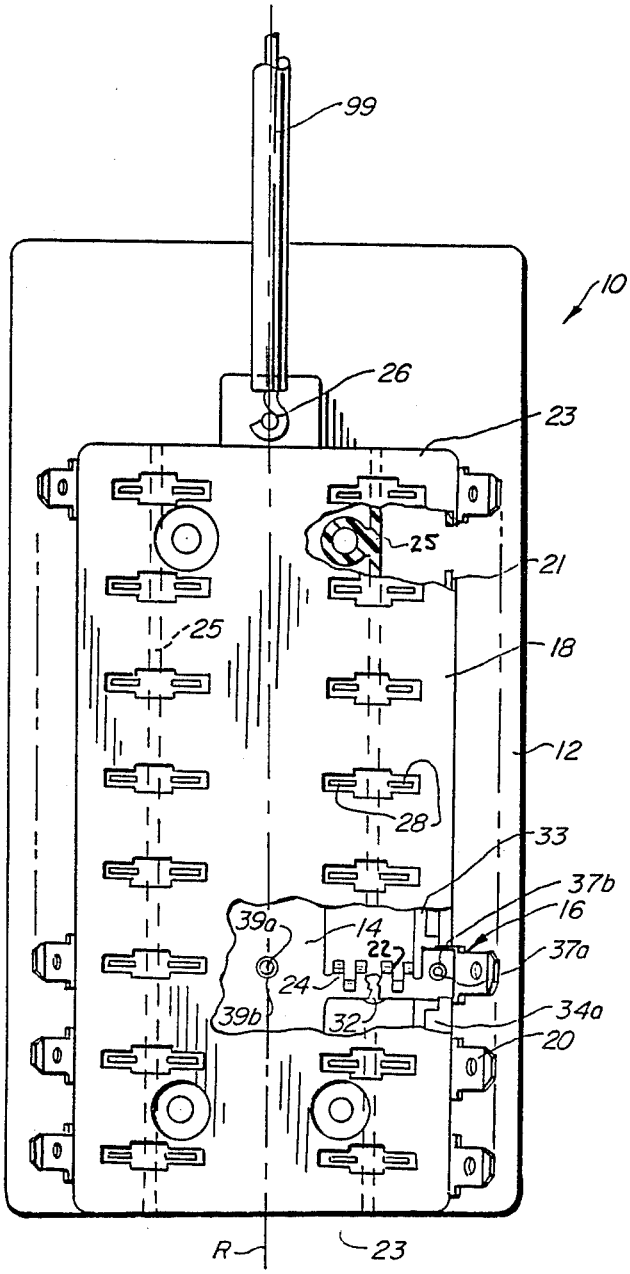
FIG. 2
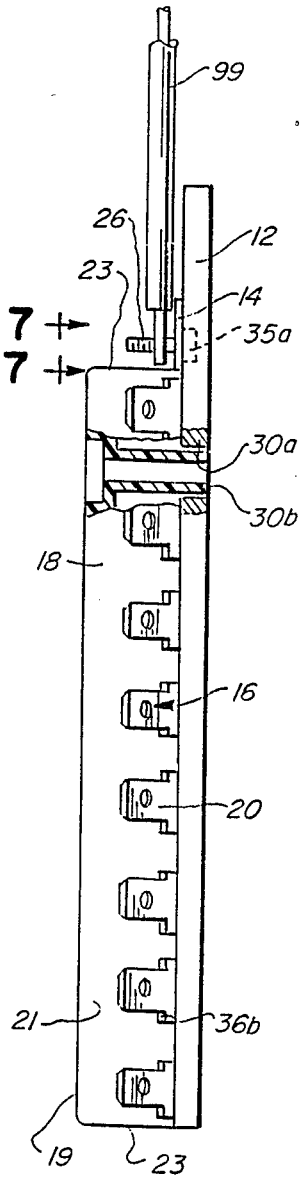
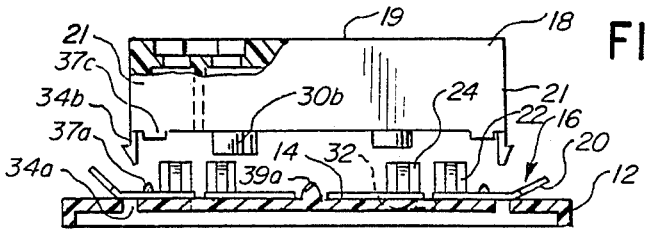
FIG. 3

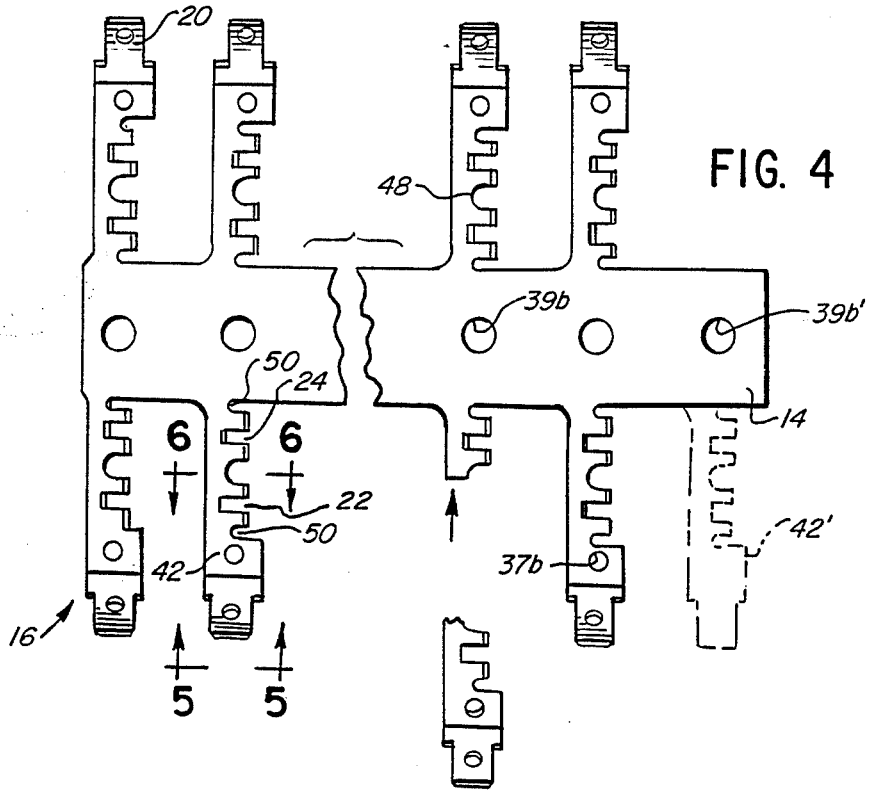
FIG. 4
FIG. 5
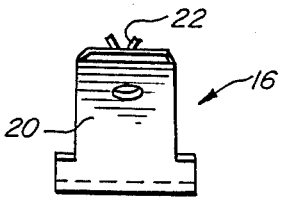
FIG. 6
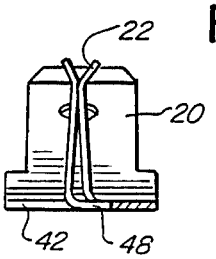
FIG. 7
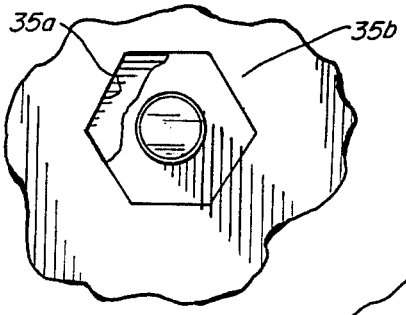
FIG. 8
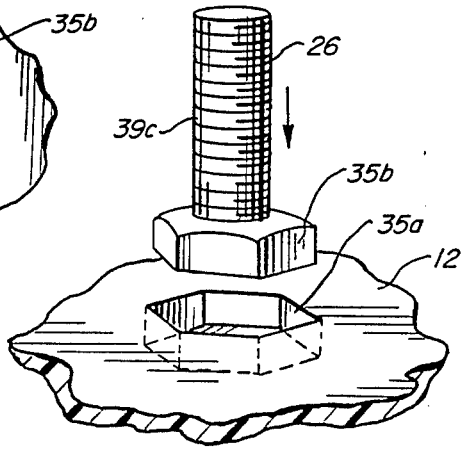

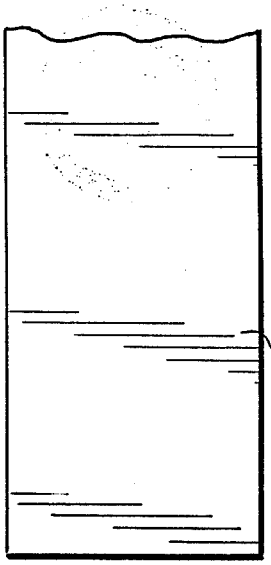
FIG. 9
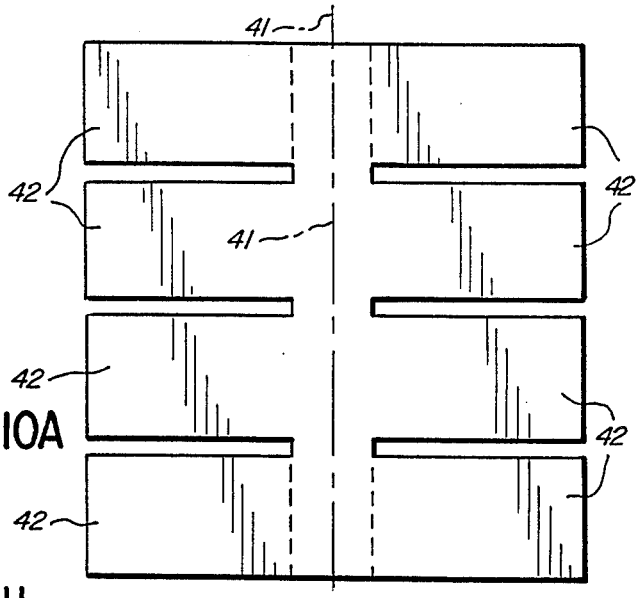
FIG. 10A
FIG. 10
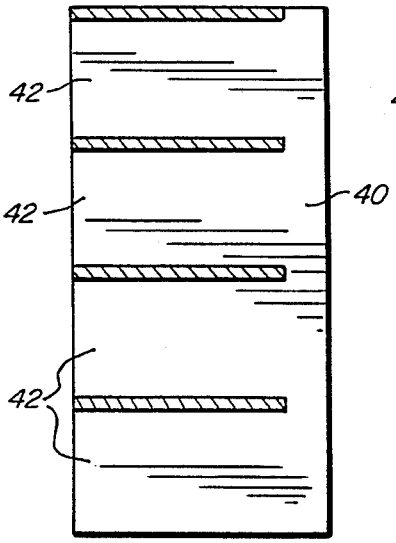
FIG. 11
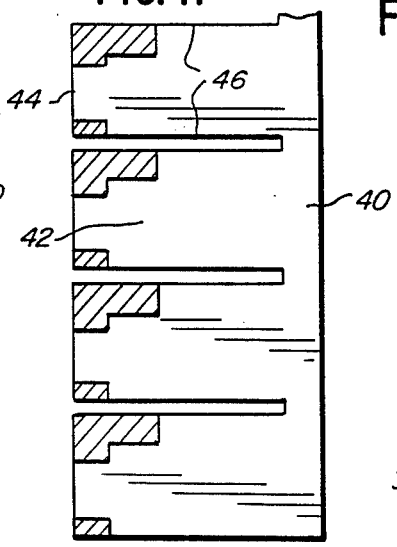
FIG. 12
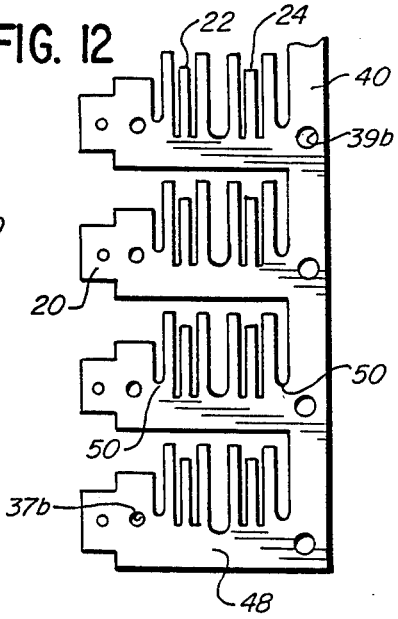
FIG. 13
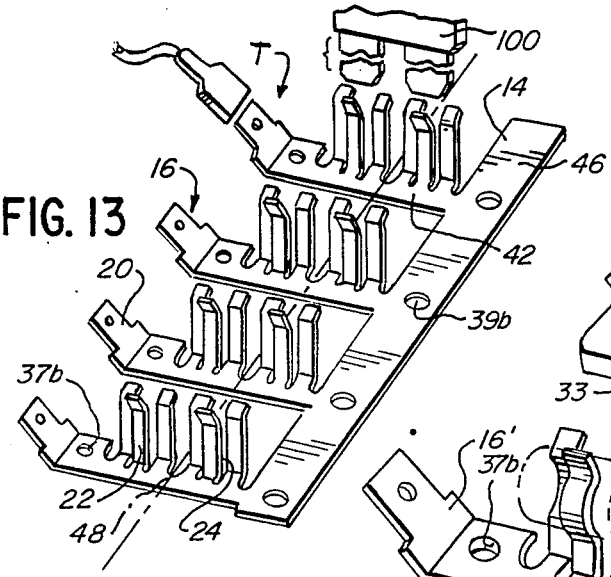
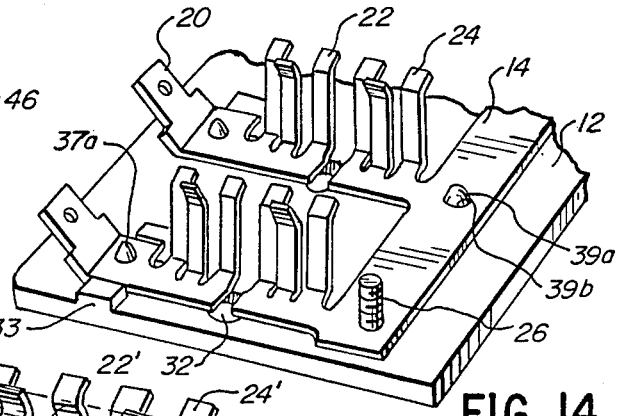
FIG. 14
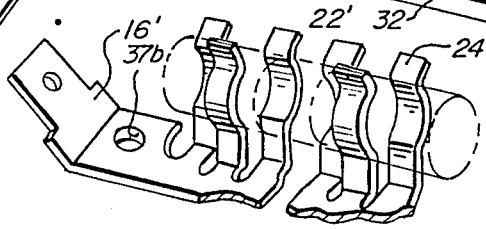
FIG. 14A

HOLDER FOR A REMOVABLE CIRCUIT ELEMENT

This application is a continuation in part of a patent application filed on Aug. 15, 1988, under Ser. No. 232,322, now U.S. Pat. No. 4,872,262 issued on Oct. 10, 1989.

TECHNICAL FIELD

This invention relates to holders for removable circuit elements and fuse blocks, in general, and to fuse blocks and holders for replaceable circuit elements having blade-type terminals, in particular.

BACKGROUND OF THE INVENTION

Plug-in fuses are disclosed in U.S. Pat. Nos. 3,909,767 and 3,962,782. Such a fuse comprises a plug-in fuse element which includes: a blade-like body of fuse metal having a pair of laterally spaced terminal blade portions to be received by pressure clip terminals in a mounting panel or fuse block; current-carrying extensions at the inner end portions of each terminal blade portion; and a fuse link portion, generally of reduced thickness and small cross-sectional area, for interconnecting the current-carrying extensions. These fuses are alternatively referred to as "ATC" fuses (ATC is a registered trademark of Cooper Industries, Inc.) and have found widespread use in electrical systems found in automobiles, motorboats and other products.

Plug-in fuses are used in conjunction with pressure clip terminals which are carried in a fuse mounting panel or by a fuse block. Generally speaking such a panel or block comprises an insulated base to which are attached pairs of terminals, each pair of terminals comprising a fuse holder. Usually one side of each fuse holder is connected to a source of power and the other side is connected to the electrical device which is protected by the fuse. The terminals are, for the most part, individually mechanically attached to the insulated base by rivets, screws, threaded fasteners and the like. Sometimes, snap-in connections, pressure gripping tabs, or heat staking is used to hold the fuse terminal on the base.

It can be appreciated from the foregoing description that the manufacture, construction, and assembly of a fuse block, especially an ATC fuse block, is difficult and labor intensive. Since the parts are small, a premium is placed on the manual dexterity of the assembler. Thus, the manufacture of ATC fuse blocks involves the use of semi-skilled workers. The use of multiple, small, dimension sensitive parts also adds to the cost of manufacturing a fuse block.

With the wide-spread acceptance of ATC fuses in mass produced products, such as automobiles and pleasure craft, there is a need for a cost-saving method of assembling a fuse block for plug-in fuses, a fuse block which is easy to assemble, one which is easily adoptable to automated assembly, and one which has fewer assembly steps.

SUMMARY OF THE INVENTION

In accordance with the present invention, a fuse holder and method of forming a holder for removable, plug-in circuit element are disclosed. Specifically, the fuse holder comprises an insulated base, an electrical bus member carried by the base and a plurality of fuse terminal members which were formed from the same blank of metal as the electrical bus member. Preferably, the terminal members and bus member were separated from each other after that blank was mounted on the insulated base. The bus member comprises a plurality of lateral branches joined to a common trunk with each branch having at its free end one integral terminal which is adapted to receive one end of a removable circuit element. Each terminal member has, at one end, an electrical terminal for an electrical connection and, at an opposite end, an integral terminal which is adapted to receive one end of a removable circuit element and which is aligned to the free end of one lateral branch. In one embodiment of the invention, the fuse holder includes an insulated cover which is carried by the base and which has a plurality of apertures which are aligned to the removable circuit element terminals of each branch so as to receive at least the ends of a removable circuit element therein.

From the foregoing description it will be seen that the holder can be formed using a minimal number of steps makes economical use of material, does not require highly skilled assembly workers, is adapted to automatic manufacturing processes, and represents a cost-effective and improved method of manufacture.

Numerous other advantages and features of the present invention become readily apparent from the following detailed description of the invention and the embodiments thereof, from the claims and from the accompanying drawings.

BRIEF DESCRIPTION OF THE DRAWINGS

FIG. 1 is a top plan view of a fuse holder that is the subject of the present invention:

FIG. 2 is a partial cross-sectional side view of the fuse holder of FIG. 1;

FIG. 3 is a partial cross-sectional end view of the fuse holder of FIG. 1;

FIG. 4 is a top plan view of the formed metal blank that is used in the fuse holder of FIG. I;

FIGS. 5 and 6 are partial side and partial side cross-sectional views of one lateral branch of the blank of FIG. 4, as viewed along lines 5—5 and 6—6, respectfully;

FIG. 7 is an enlarged partial plan view of the threaded terminal at one end of the fuse holder of FIG. 1, as viewed along line 7—7;

FIG. 8 is a partial perspective view of the threaded terminal of FIG. 7, as viewed along line 8—8;

FIGS. 9 through 14 are pictorial representations of a sequence of steps which, when performed, result in the assembly of the fuse block of FIG. 1;

FIGS. 10A, 14A, 15A through 15E, and 16 are representations of alternate embodiments of various features of the invention;

DETAILED DESCRIPTION OF THE PREFERRED EMBODIMENT

Figure 15A:
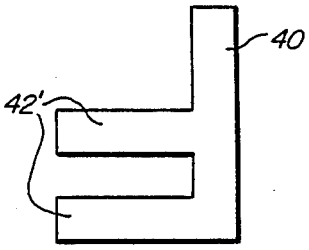
Figure 15B:
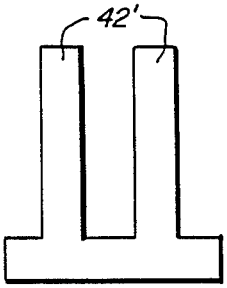
Figure 15C:
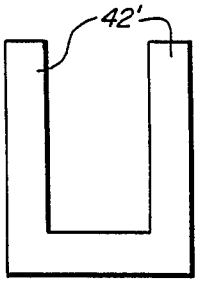
Figure 15D:
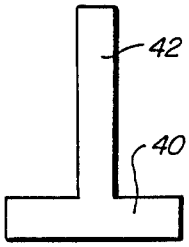
Figure 15E:
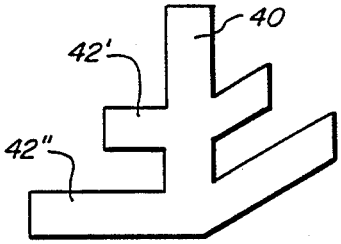
Figure 15F:
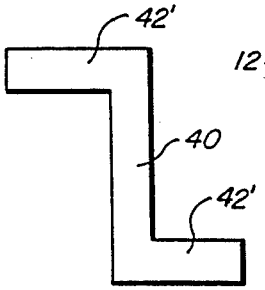

While this invention is susceptible of embodiment in many different forms, there is shown in the drawings and will herein be described in detail several embodiments of the invention. It should be understood, however, that the present disclosure is to be considered as an exemplification of the principles of the invention and is not intended to limit the invention to the specific embodiments illustrated.

Before describing the method to manufacture the holder that is the subject of the present invention, the holder resulting from the method will be described so as to facilitate an understanding of the manufacturing process. It should be understood that, in the discussion which follows, the term "fuse holder" is used in a general sense for a holder for removable circuit elements such as a fuse or a plug-in circuit element.

FUSE BLOCK

Turning to FIGS. 1, 2, and 3, the fuse holder 10 that is the subject of the present invention comprises: an insulated base 12, an electrical bus member or terminal plate 14, a plurality of fuse terminal members 16 and an insulated cover 18. Each terminal member 16 has at one end an electrical terminal 20 and at its opposite end, an integral fuse terminal 22. The fuse terminal 22 on the fuse terminal member 16 is aligned and spaced apart from a corresponding fuse terminal 24 on the terminal plate 14. In the particular embodiment illustrated in the drawings, the fuse terminals are pressure clip terminals comprising trifurcations which are adapted to accept the generally flat blade portions of a plug-in fuse. Trifurcated pressure clip terminals are easier to manufacture than so-called quick-connect terminals or AMP type terminals (See FIG. 13 at "T"). Moreover, they do not have to be constricted to the precise tolerances of AMP type terminals. The terminal plate 14, in this particular embodiment is adapted to be connected to an electrical source 99 by means of a threaded fastener 26 and the electrical terminal 20 is a spade quick-connect terminal. Other connection means may be used.

Figure 18A:
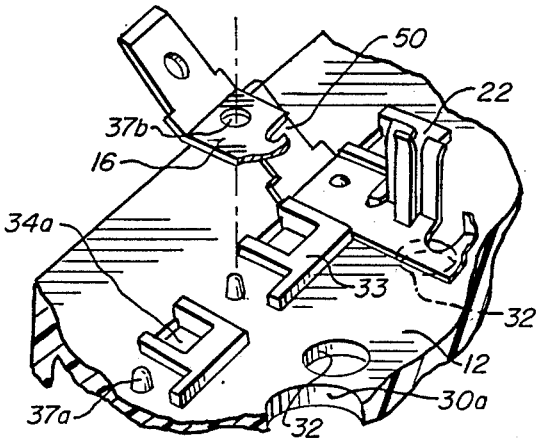
FIGS. 18A and 18B are partial perspective views of two embodiments of the insulated base of FIG. 1.

The insulated base 12 is a generally flat structure (See FIG. 3) made from thermal plastic by injection molding so as to be suitable for mounting thereon the terminal plate 14 and the terminal members 16. The insulated base 12 is provided with a series of mounting apertures 30*a* (See FIG. 2) which can be used to mount the base, die-stamp apertures 32, cover securing apertures 34*a* and hardware mounting apertures 35*a* (See FIG. 8). The base member 12 is also provided with a series of pin-like projections 37*a* and 39*a* which are aligned to corresponding securing apertures 37*b* in the fuse terminal members 16 (See FIGS. 18A and 18B) and apertures 39*b* in the terminal plate 14 (See FIG. 4). To facilitate alignment and to insure that the fuse terminal members 16 are properly located, a plurality of raised recesses 33 are provided on each side of the fuse terminal projections 37*a* (see detail in FIGS. 18A and A8B).

Figure 17:
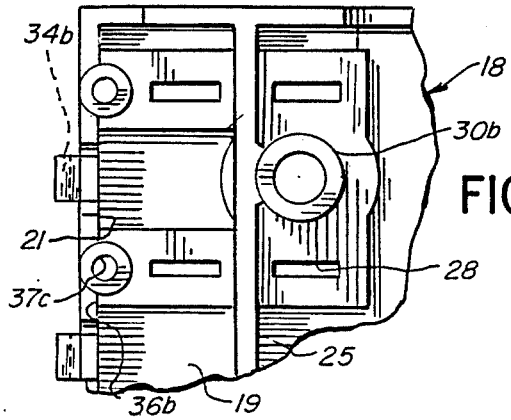
FIG. 17 is a partial bottom plan view of the cover of the fuse holder of FIG. 1.

The cover member 18 is a generally flat, five-sided structure (See FIG. 3) which is made from thermal plastic by injection molding and which includes a top wall 19, two side walls 21, two end walls 23, and two interior barrier walls 25 (see FIG. 17). The top wall 19 has a plurality of fuse accepting apertures 28. The side walls 21 have a plurality of securing tabs 34*b* and recesses 36*b* for the electrical terminals 20, such that the electrical terminals of the fuse terminal members 16 are exposed. The fuse apertures 28 are aligned with the fuse terminals 22 and 24 carried by the insulated base 12. Additional apertures may be provided for electrically connecting one end of the terminal plate 14 at a position outside of the cover. The inside of the cover 18 (see FIG. 17) has two barrier walls 25, tube-like extensions 30*b* to be received by the base mounting apertures 30*a*, and tube-like extensions 37*c* to receive the fuse terminal projections 37*a*.

METHOD

Turning now to FIGS. 9 through 14, the method of forming the terminal plate 14 will now be described. The terminal plate 14 is die-stamped from a generally flat blank of metal or copper alloy 15, such as a long strip of electrical grade brass. To each side of a common trunk member 40 (see reference line 41) are formed a plurality of generally parallel branches 42. To simplify the drawings (see FIGS. 10 through 14), branches 42 are shown formed only on one side of the trunk number 40. However, it should be understood that branches 42' can be formed to each side or to one side of the trunk member 40 (See FIGS. 15A through 15F), symmetrically or asymmetrically, relative to a base reference line. Moreover, the branches need not be parallel or at right angles to the trunk, and other separation techniques, besides die-stamping, may be used. Each branch 42 is separated from the others by spaced distance. Each branch has a relatively short free end or distal end 44 and two relatively long edges 46 which join the free end to the trunk member 40 (See FIG. 11). Formed along one long edge 46 of each branch 42 are two fuse securing terminals 22 and 24, each comprising trifurcations. The two fuse terminals 22 and 24 are separated from each other by a lateral section 48 of reduced width (See FIG. 12). Each terminal 22 and 24 is partially separated from the free end 44 and the trunk member 40 by two recesses or channels 50. The purpose of the reduced width section 48 and the recesses 50 will become apparent from the description which follows. At the free end 44 of the branch 42, the electrical connecting terminal 20 is formed. In this particular embodiment, the electrical terminals 20 at the end of each branch 42 are of the well-known quick-connect variety. They provide a complete gripping surface and give good engagement strength. A large contact surface also affords the highest affordable electrical conductivity. Other electrical terminal connecting means may be stamped into each branch, i.e., screw connections, trifurcations, box connector, solder connectors, etc. Here the electrical terminals 20 are formed approximately 45 degrees to the plane of the terminal plate (See FIG. 3).

Each fuse terminal 22 and 24 is formed generally at right angles (See FIG. 13) to the plane of the terminal plate 14. The fuse terminals 22 and 24 are separated from each other by a distance generally equal to the distance between the blade portions of the associated fuse 100. Between the electrical terminal 20 at the free end of each branch and the adjacent fuse terminal 22, a securing aperture 37*b* is formed. Finally, a plurality of apertures 39*b* are formed on the trunk 40. Proper alignment of the formed blank on the insulated base 12 is facilitated by means of cooperating projections 37*a*, and 39*a*, and apertures 37*b* and 39*b* and by means of the cooperating raised insulated recesses 33 (See FIGS. 18A and 18B) and metal recess 50. The apertures 37*b* and 39*b* in conjunction with projections 37*a* and 39*a* on the insulated base 12 facilitate heat staking of the two parts, should that become necessary.

The steps just described are conveniently accomplished using die stamping techniques and metal punching methods much as that used in U.S. Pat. No. 3,140,364. One or more punching steps may be used. FIGS. 9 through 14 are illustrative.

From the foregoing it will also be appreciated that the formed metal blank may be of any length (See FIG. 4) and any number of branches may be formed therein.

Here (See FIG. 1) the finished terminal plate 14 has eight branches on each side of a longitudinal reference line "R".

Prior to mounting the terminal plate 14 on the insulated base 12 one pair of lateral branches 42, (See FIG. 4) may be removed. This will allow the trunk to extend out of the cover area so as to provide a convenient point of attachment to a source of power 99. The reduced width lateral section 50 at the proximate end of each branch facilitates easy removal.

Prior to mounting the finished blank on the insulated base 12, a threaded fastener 26 may be mounted onto the base (See FIG. 8). Here the hex-head **35*b* of a bolt is inserted into a corresponding cavity 35*a* in the base 12. The threaded portion 39*c* of the bolt is preferably selected to pass through a corresponding aperture 39*b*' in the terminal plate 14. This allows good electrical contact for all of the fuse protected loads. Of course other means may be used to electrically connect the terminal plate 14. Moreover, the electrical connection may be made inside the protective cover by means of a suitable aperture in one of the end walls 23**.

After the terminal plate 12 is formed, it is mounted on the insulated base 12. The apertures **39*b* on the terminal plate 14 are received by the projections 39*a* on the insulated base 12 and the slots 50 at the ends of each branch fit within the alignment recesses 33 (See FIG. 18A). When so mounted the die stamp apertures 32 are located below the reduced width sections 48 between the two fuse terminals 22 and 24 of each branch 42**. At this point the finished blank may be heat staked in position.

Once the formed blank is mounted on the insulated base, a die stamping machine is used to sever or cut each lateral branch 42 at a position 48 generally midway between the two fuse terminals 22 and 24. The process of die stamping forms a plurality of fuse terminal members 16 and a common bus member 14 in one step (See FIG. 14). Heretofore, the fuse terminal members and bus member were added to the base serially. Such a process is time consuming and requires good manual dexterity if the assembly was to be completed without error and with good quality.

After the fuse terminal members 16 are separated from the common bus member, the cover 18 is installed. Here the cover securing tabs **34*b* are forced into the corresponding apertures 34*a* in the base 12. The tube-like extensions 37*c*, located on the inside of the cover 18, are received by the pins or projections 37*a* on the base, thereby securely holding the fuse terminal members in place. The barrier walls 25 reduce the potential for arcing between the fuse terminals 22 and 24. In addition, the tube-like extensions 30*b* on the inside of the cover 19 fit within apertures 30*a* in the base 12 (See FIG. 2** detail).

Figure 16:
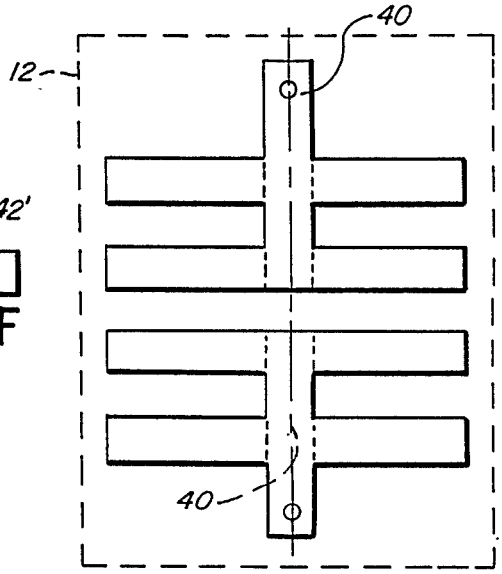
Figure 18B:
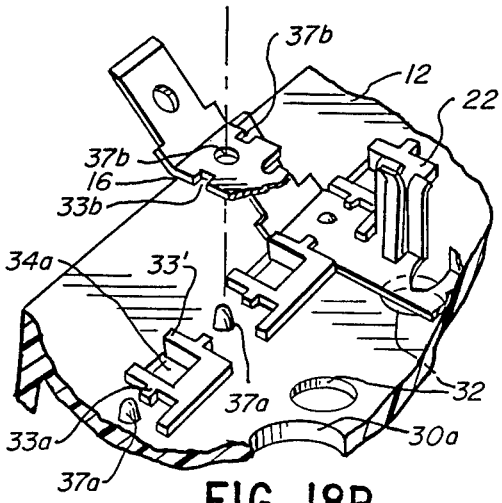

From the foregoing description, it will be observed that numerous variations and modifications may be effected without departing from the true spirit and scope of the novel concept of the invention. For example, FIG. 14A shows how the terminal plate may be formed to have terminals 22' and 24' for accepting a cylindrical type fuse. Of course, a different cover would be used. Other fuse accepting terminals (i.e., bifurcations), fuses and plug-in circuit elements (e.g., circuit breakers, disconnects, jumpers, etc.) may be accommodated. As another example, FIG. 16 depicts an embodiment wherein two formed metal blanks are located at opposite ends of a common insulated base 12; thus, two or more power sources may be protected from the same fuse block. In a similar fashion, FIG. 18B illustrates an embodiment wherein the alignment recesses 33' on the insulated cover 12 are provided with two oppositely disposed extensions which fit within two oppositely disposed recesses **33*b* in fuse terminal member 16'. Moreover, it should be understood that, although the formed blank is preferably mounted on the insulated base before die stamping it to form a plurality of fuse terminal members (16 and a common bus member 14**), the formed blank may be first mounted on a carrier for die stamping and then the separated bus member and fuse terminals transferred in unison to the insulated base. This later method is somewhat more inefficient, but may be practical where labor costs are low. Thus, should be understood that no limitation with respect to the specific apparatus illustrated herein is intended or should be inferred. It is, of course, intended to cover by the appended claims all such modifications as fall within the scope of the claims.

I claim:

1. A holder for a removable circuit element having two end terminals, comprising:

(a) an insulated base;

(b) an electrical bus member carried by said base, said bus member comprising a plurality of lateral branches joined to a common trunk, each branch having at its free end one integral terminal for receiving one end terminal of a removable circuit element; and (c) a plurality of terminal members carried by said base and aligned to said lateral branches, each terminal member having at one end an electrical terminal for an electrical connection thereto and having at an opposite end one integral terminal for receiving one end terminal of a removable circuit element, said one integral terminal being spaced apart from said one integral terminal on an aligned said lateral branch so as to receive a removable circuit element therebetween, said terminal members and said bus member having been formed from the same blank of metal.

2. The holder of claim 1, wherein said terminal members and said bus member were separated from each other after said blank was mounted on said insulated base.

3. The holder of claim 1, wherein said terminal members were separated from said bus member by die-stamping means.

4. The holder of claim 1, further including an insulated cover carried by said base, said cover comprising a top member having at least one aperture which is aligned to said spaced apart integral terminals and which is adapted to receive at least the ends of a removable circuit element therein.

5. The holder of claim 4, further including threaded fastener means having a head carried by said base and having an opposite end projecting upwardly from said base, and wherein said bus member and said top member have apertures to receive said threaded fastener means intermediate the ends of said threaded fastener means.

6. The holder of claim 5, wherein said top member leaves said opposite end of said threaded fastener exposed.

7. The holder of claim 4, further including a plurality of tabs carried by said top member; and wherein said base includes slot means aligned to said tabs for attaching said cover onto said base.

8. The holder of claim 4, wherein said cover comprises a wall member which is joined to said top member and which is disposed between the ends of said terminal members so that said electrical terminals of said terminal members are exposed.

9. The holder of claim 4, wherein said cover comprises a wall member which is joined to said top member and which is disposed between said spaced apart integral terminals.

10. The holder of claim 1, further including a cover comprising:

an insulated top wall having a plurality of circuit element receiving apertures which are aligned to said spaced apart integral terminals and which are adapted to receive a removable circuit element therein;

a side wall which is joined to said top wall, which has tabs which are adapted to be received by cover securing apertures in said insulated base and which is positional relative to said bus member to expose said electrical terminals at the end of each branch; and a barrier wall which is joined to said top wall and which is located between said insulated base and said top wall and between said two spaced apart integral terminals.

11. The holder of claim 10, wherein said insulated base includes projections for aligning said terminal members to said bus member, and wherein said cover includes means, receiving said projections, for securing said terminal members between said cover and said insulated base.

12. The holder of claim 1, wherein said insulated base includes a plurality of projections for aligning said terminal members to said bus member.

13. The holder of claim 12, wherein at least one alignment aperture is formed in said bus member for receiving one of said projections and at least one alignment aperture is formed in said terminal member for receiving one of said projections.

14. The holder of claim 1, wherein said branches are formed generally parallel to each other and generally perpendicular to said trunk member, and wherein said integral terminals on said branches and on said terminal members comprise trifurcations.

15. The holder of claim 1, wherein said integral terminals are formed along non-adjacent edges of each branch and are generally perpendicular to the plane of each branch.

16. The holder of claim 1, wherein said circuit element is a plug-in fuse.

17. The holder of claim 1, further including means, carried by said base and electrically connected to said electrical bus member, for making an electrical connection to said bus member.

18. The holder of claim 1, wherein said terminal members are carried by said base by means of pins on said base and complementary apertures in each terminal member.

19. A holder for a blade type plug-in circuit element, comprising:

(a) an insulated base defining a generally flat surface, having a plurality of die stamping apertures and cover securing apertures in said surface , and having aligning means for aligning on said surface an electrical bus member and a plurality of terminal members, said aligning means including a plurality of pin-like projections which extend upwardly from said surface;

(b) an electrical bus member carried by said insulated base, said bus member comprising a common trunk and a plurality of branches, each branch having a proximate end which is joined to said common trunk and having an integral terminal at its distal end;

(c) a plurality of terminal members which are carried on said surface of said insulated base and which are aligned to said branches by said aligning means, each terminal member having at one end an integral electrical terminal and having at an opposite end one integral terminal which is spaced apart from a similar said terminal on a said aligned branch so as to receive a blade type plug-in circuit element between said terminals, each of said terminal members having an aperture which is located intermediate its ends and which is received by one of said upwardly extending projections on said base, said terminal members and said bus member having been formed from the same blank of metal and having been separated from each other at said die stamping apertures after said blank was aligned on said surface of said insulated base; and (d) an insulated cover carried by said insulated base, said cover comprising a top wall having a plurality of plug-in circuit element receiving apertures which are aligned to said integral terminals at said distal end of each branch and to said similar terminals of said aligned terminal members and which are adapted to receive a blade type plug-in circuit element therein, comprising a side wall which is joined to said top wall and which has tabs which are received in said cover securing apertures in said insulated base so that said electrical terminal of each terminal member is exposed, comprising a barrier wall which is joined to said top wall and which is disposed between said insulated base and said top wall and between said integral terminals at said distal end of each branch and said similar terminals of said aligned terminal members, and comprising means for receiving said projections of said alignment means to secure said plurality of terminal members between said cover and said insulated base.

20. The holder of claim 19, wherein said bus member includes a tab which extends outside of said cover.

21. A holder for a removable circuit element having two blade-like end terminals, comprising:

(a) an insulated base;

(b) an electrical bus member carried by said base, said bus member comprising a plurality of lateral branches joined to a common trunk, each branch having at its free end one integral trifurcated terminal which is adapted to receive one of the two terminals of the removable circuit element; and (c) a plurality of terminal members which are carried by said base and which are aligned to said lateral branches, each terminal member having at one end an electrical terminal for an electrical connection thereto and having at an opposite end one integral trifurcated terminal which is adapted to receive the other of the two terminals of the removable circuit element, said trifurcated terminals being separated from each other by a predetermined distance generally equal to the distance between the end terminals of the removable circuit element, said trifurcated terminals having trifurcations which are disposed generally at an angle to the plane of said blank.

22. The holder of claim 21, wherein said terminal members and said bus member were formed from the same blank of metal and were separated from each other by die-stamping means after said blank was mounted on said insulated base.

23. The holder of claim 21, further including an insulated top and at least one wall which is joined to said top, said top having said one aperture and said wall being disposed between the free end of at least one branch and that terminal of said circuit element which is joined to said free end such that said free end is exposed.

24. The holder of claim 21, further including an insulated top having said one aperture therein; and a wall which is joined to said top at a location generally bisecting said one aperture such that said wall is located between said terminals of said one pair.

25. The holder of claim 23, wherein said top has a plurality of apertures which are aligned to said trifurcations and which are adapted to receive said terminals of said plug-in circuit element.

26. The holder of claim 21, wherein said plurality of generally parallel branches are formed on both sides of said reference line and generally at right angles to said reference line.

27. The holder of claim 21, wherein said trifurcations are formed along non-adjacent long edges of each branch.

28. The holder of claim 21, wherein said trifurcations are formed generally at right angles to the plane of said blank.

29. The holder of claim 21, further including at least one mounting aperture is formed in said trunk member and one securing aperture is formed in each branch adjacent said short free end.

* * * * *